US008522555B2

(12) United States Patent
Berry et al.

(10) Patent No.: US 8,522,555 B2
(45) Date of Patent: Sep. 3, 2013

(54) MULTI-PREMIXER FUEL NOZZLE SUPPORT SYSTEM

(75) Inventors: Jonathan Dwight Berry, Simpsonville, SC (US); Kevin Weston McMahan, Greer, SC (US); Carl Robert Barker, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1112 days.

(21) Appl. No.: 12/469,507

(22) Filed: May 20, 2009

(65) Prior Publication Data

US 2010/0293955 A1 Nov. 25, 2010

(51) Int. Cl.
*F23R 3/14* (2006.01)

(52) U.S. Cl.
USPC ..... 60/748; 60/746

(58) Field of Classification Search
USPC ..... 60/804, 748, 746, 747, 737, 740
See application file for complete search history.

(56) References Cited

U.S. PATENT DOCUMENTS 3,283,802 A * 11/1966 Farnham ..... 431/13
4,408,461 A * 10/1983 Bruhwiler et al. ..... 60/737
6,438,961 B2 8/2002 Tuthill et al.
6,796,173 B1 9/2004 Lajoie et al.
7,007,477 B2 3/2006 Widener
7,377,036 B2 5/2008 Johnson et al.
2001/0052229 A1 12/2001 Tuthill et al.
2005/0268614 A1 12/2005 Widener
2006/0070237 A1 4/2006 Johnson et al.
2006/0144303 A1 7/2006 Loving
2007/0151255 A1* 7/2007 Johnson et al. ..... 60/776
2007/0277530 A1 12/2007 Dinu et al.
2010/0132364 A1* 6/2010 Myers et al. ..... 60/748
2010/0275601 A1* 11/2010 Berry et al. ..... 60/737
2012/0031097 A1* 2/2012 McMahan et al. ..... 60/738

FOREIGN PATENT DOCUMENTS

EP 0936406 8/1999
EP 1645806 4/2006
EP 1865261 12/2007

OTHER PUBLICATIONS

U.S. Appl. No. 12/325,559, filed Dec. 1, 2008, Myers et al.

* cited by examiner

*Primary Examiner* — William H Rodriguez
*Assistant Examiner* — Carlos A Rivera
(74) *Attorney, Agent, or Firm* — Fletcher Yoder P.C.

(57) ABSTRACT

A system comprising a fuel nozzle. The fuel nozzle includes a mounting base and an inlet flow conditioner extending directly from the mounting base in a downstream direction. Moreover, the inlet flow conditioner structurally supports the fuel nozzle without a central support member extending directly from the mounting base inside the inlet flow conditioner.

16 Claims, 6 Drawing Sheets

MULTI-PREMIXER FUEL NOZZLE SUPPORT SYSTEM

BACKGROUND OF THE INVENTION

The subject matter disclosed herein relates generally to turbine engines and, more specifically, to a fuel nozzle support system.

Fuel-air mixing affects engine performance and emissions in a variety of engines, such as turbine engines. For example, a gas turbine engine may employ one or more fuel nozzles to intake air and fuel to facilitate fuel-air mixing in a combustor. The nozzles may be located in a head end portion of a turbine, and may be configured to intake an air flow to be mixed with a fuel input. Typically, the nozzles may be internally supported by a center body inside of the nozzle. However, in certain situations, support via a center body may increase the overall cost and complexity of the nozzle.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a turbine engine comprising a combustor having a head end, and a fuel nozzle having a mounting base coupled to the head end, wherein the fuel nozzle comprises an inlet flow conditioner extending to the mounting base, the inlet flow conditioner comprises a plurality of air inlets, and the inlet flow conditioner structurally supports the fuel nozzle at the mounting base.

In a second embodiment, an apparatus includes a fuel nozzle comprising a mounting base, an inlet flow conditioner extending directly from the mounting base in a downstream direction, and a lateral support disposed inside the inlet flow conditioner, wherein the lateral support extends crosswise relative to a longitudinal axis of the fuel nozzle.

In a third embodiment, a system includes a fuel nozzle comprising a mounting base, and an inlet flow conditioner extending directly from the mounting base in a downstream direction, wherein the inlet flow conditioner structurally supports the fuel nozzle without a central support member extending directly from the mounting base inside the inlet flow conditioner.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
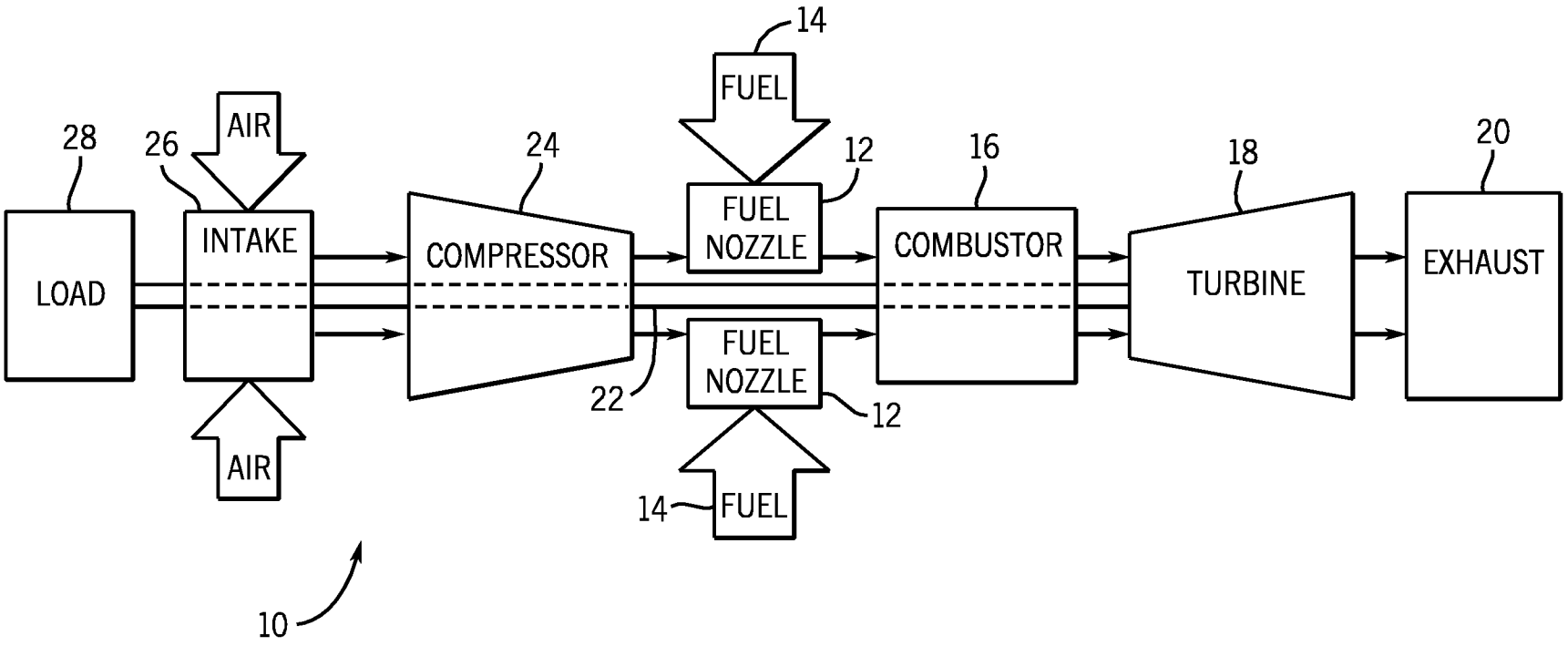
FIG. 1 is a block diagram of a turbine system having a fuel nozzle coupled to a combustor in accordance with an embodiment of the present technique.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed below, certain embodiments of a fuel nozzle employ an external support structure with an inlet flow conditioner (IFC), rather than an internal support structure and a separate external IFC. The support structure may be described as the load bearing portion of the fuel nozzle. Thus, as discussed below, the disclosed embodiments do not rely on load-bearing internal fluid passages, but rather the disclosed embodiments rely on external structural support separate from the internal fluid passages. For example, the support structure may include a mounting base extending to an external wall (e.g., annular wall), which in turn supports the internal fuel and air passages. Furthermore, in the disclosed embodiments, the external wall may include the IFC, e.g., perforations. The IFC is configured to condition the air entering the fuel nozzle by, for example, providing a more uniform distribution and flow of the air. As appreciated, the integration of the IFC and the support structure reduces the complexity, material usage, and costs associated with manufacturing the fuel nozzle. In certain embodiments, the IFC (e.g., perforations) may be disposed in the external wall axially adjacent to the mounting base.

The disclosed embodiments also include a multi-nozzle assembly with an external support structure and IFC integrated together. For example, the multi-nozzle assembly may include a plurality of fuel nozzles supported by an external structural support (e.g., mounting base and external wall), wherein the external wall and/or an internal crosswise support includes the IFC (e.g., perforations) configured to condition the air flow into the plurality of fuel nozzles. The external wall and/or internal crosswise support may define a common IFC for all of the fuel nozzles, or alternatively an independent IFC for each fuel nozzle. One specific embodiment includes a tri-nozzle (e.g., three fuel nozzles) integrated together with a single external support structure (e.g., mounting base and external wall), wherein the external wall and/or the internal crosswise support includes the IFC (e.g., perforations) for all three of the fuel nozzles. Again, the structural support is at least substantially external rather than internal to the fuel nozzles (e.g., not a load bearing fluid passage), thereby simplifying the internal fluid passages inside the fuel nozzles. For example, the disclosed embodiments employ non-load bearing internal fluid passages (e.g., air, fuel, water, diluent, etc), rather than load bearing internal fluid passages. These non-load bearing internal fluid passages may be flexible or resilient, e.g., a bellows tube. In addition, the external support structure increases the stiffness of the multi-nozzle assembly. In certain embodiments, the natural frequency or stiffness can be adjusted or tuned by increasing the material thickness of the external wall with the integral IFC. Furthermore, a perforated plate may be used to further stiffen the multi-nozzle assembly and condition the air flow entering the fuel nozzles.

Turning now to the drawings and referring first to FIG. 1, an embodiment of a turbine system 10 may include one or more fuel nozzles 12 with an external support structure having an integral inlet flow conditioner (IFC). Although the fuel nozzles 12 are illustrated as simple blocks, each illustrated fuel nozzle 12 may include multiple fuel nozzles integrated together in a group and/or a standalone fuel nozzle, wherein each illustrated fuel nozzle 12 relies at least substantially or entirely on external structural support (e.g., load bearing wall with integral IFC) rather than internal structural support (e.g., load bearing fluid passages). However, each fuel nozzle 12 may include an internal crosswise support to supplement the external structural support, yet still not employ load bearing fluid passages.

The turbine system 10 may use liquid or gas fuel, such as natural gas and/or a hydrogen rich synthetic gas, to run the turbine system 10. As depicted, a plurality of fuel nozzles 12 intakes a fuel supply 14, mixes the fuel with air, and distributes the air-fuel mixture into a combustor 16. The air-fuel mixture combusts in a chamber within combustor 16, thereby creating hot pressurized exhaust gases. The combustor 16 directs the exhaust gases through a turbine 18 toward an exhaust outlet 20. As the exhaust gases pass through the turbine 18, the gases force one or more turbine blades to rotate a shaft 22 along an axis of the system 10. As illustrated, the shaft 22 may be connected to various components of the turbine system 10, including a compressor 24. The compressor 24 also includes blades that may be coupled to the shaft 22. As the shaft 22 rotates, the blades within the compressor 24 also rotate, thereby compressing air from an air intake 26 through the compressor 24 and into the fuel nozzles 12 and/or combustor 16. The shaft 22 may also be connected to a load 28, which may be a vehicle or a stationary load, such as an electrical generator in a power plant or a propeller on an aircraft, for example. As will be understood, the load 28 may include any suitable device capable of being powered by the rotational output of turbine system 10.

Figure 2:
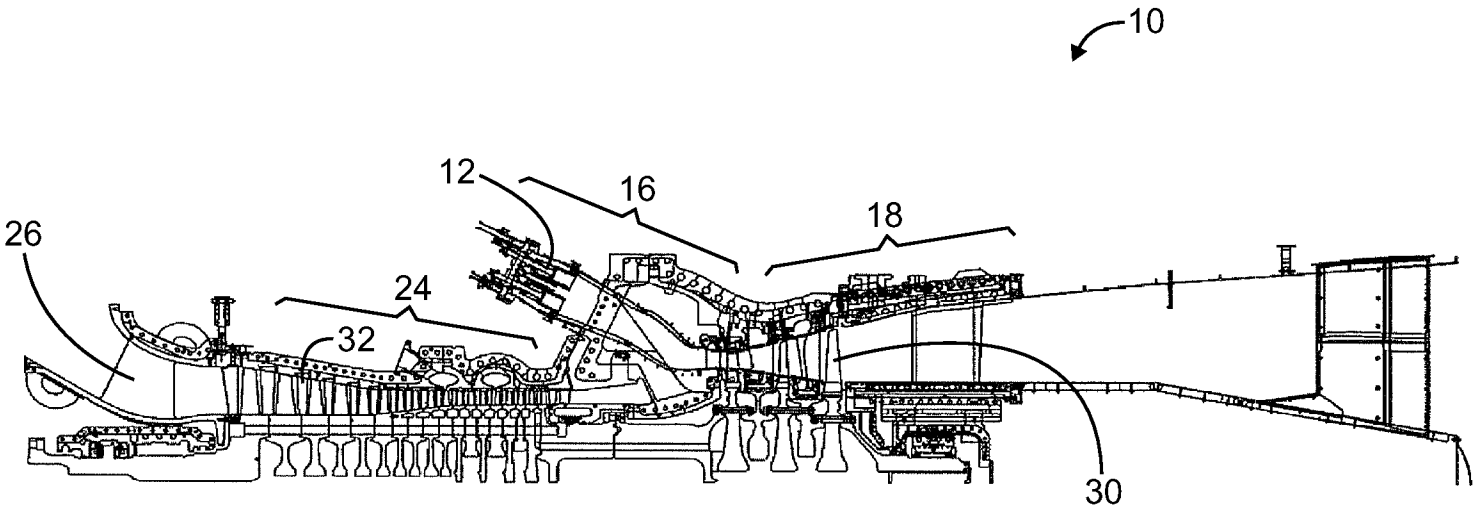
FIG. 2 is a cross sectional side view of an embodiment of the turbine system, as illustrated in FIG. 1, in accordance with an embodiment of the present technique.

FIG. 2 illustrates a cross sectional side view of an embodiment of the turbine system 10 schematically depicted in FIG. 1. The turbine system 10 includes one or more fuel nozzles 12 located inside one or more combustors 16. Again, as discussed in further detail below, each illustrated fuel nozzle 12 may include multiple fuel nozzles integrated together in a group and/or a standalone fuel nozzle, wherein each illustrated fuel nozzle 12 relies at least substantially or entirely on external structural support (e.g., load bearing wall with integral IFC) rather than internal structural support (e.g., load bearing fluid passages). In operation, air enters the turbine system 10 through the air intake 26 and may be pressurized in the compressor 24. The compressed air may then be mixed with gas for combustion within combustor 16. For example, the fuel nozzles 12 may inject a fuel-air mixture into the combustor 16 in a suitable ratio for optimal combustion, emissions, fuel consumption, and power output. The combustion generates hot pressurized exhaust gases, which then drive one or more blades 30 within the turbine 18 to rotate the shaft 22 and, thus, the compressor 24 and the load 28. The rotation of the turbine blades 30 causes rotation of the shaft 22, thereby causing blades 32 within the compressor 24 to draw in and pressurize the air received by the intake 26.

Figure 3:
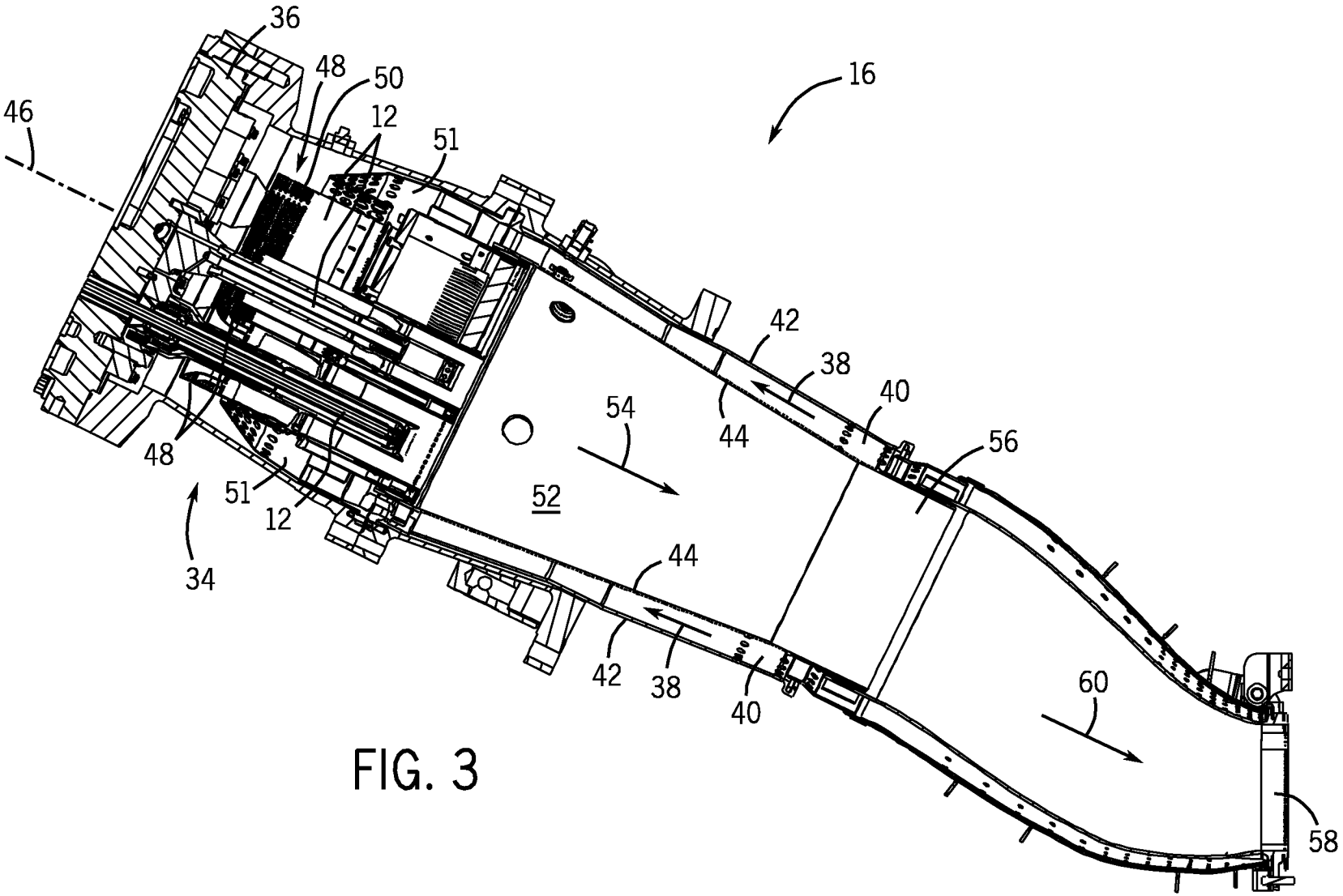
FIG. 3 is a cross sectional side view of an embodiment of the combustor having one or more fuel nozzles, as illustrated in FIG. 2, in accordance with an embodiment of the present technique.

FIG. 3 is a cross sectional side view of an embodiment of the combustor 16 having one or more fuel nozzles 12, which may be positioned to draw compressed air from a head end region 34. Again, as discussed in further detail below, each illustrated fuel nozzle 12 may include multiple fuel nozzles integrated together in a group and/or a standalone fuel nozzle, wherein each illustrated fuel nozzle 12 relies at least substantially or entirely on external structural support (e.g., load bearing wall with integral IFC) rather than internal structural support (e.g., load bearing fluid passages). An end cover 36 may include conduits or channels that route fuel and/or pressurized air to the fuel nozzles 12. Compressed air 38 from the compressor 24 flows into the combustor 16 through an annular passage 40 formed between a combustor flow sleeve 42 and a combustor liner 44. The compressed air 38 flows into the head end region 34, which contains a plurality of fuel nozzles 12. In particular, in certain embodiments, the head end region 34 may include a central fuel nozzle 12 extending through a central longitudinal axis 46 of the head end region 34 and a plurality of outer fuel nozzles 12 disposed around the central longitudinal axis 46. However, in other embodiments, the head end region 34 may include only one fuel nozzle 12 extending through the central longitudinal axis 46. The particular configuration of fuel nozzles 12 within the head end region 34 may vary between particular designs.

In general, however, the compressed air 38 which flows into the head end region 34 may flow into the fuel nozzles 12 through a nozzle inlet flow conditioner (IFC) 48 having inlet perforations 50, which may be disposed in outer cylindrical walls of the fuel nozzles 12. In addition, the head end region 34 may include a flow conditioner 51 configured to condition the air prior to entry into the IFC 48 of each fuel nozzle 12. The flow conditioner 51 is configured to break up large scale flow structures (e.g., vortices) of the compressed air 38 into smaller scale flow structures as the compressed air 38 is routed into the head end region 34. In addition, the flow conditioner 51 guides or channels the air flow in a manner providing more uniform air flow distribution among the different fuel nozzles 12, which also improves the uniformity of air flow into each individual fuel nozzle 12. Accordingly, the compressed air 38 may be more evenly distributed to balance air intake among the fuel nozzles 12 within the head end region 34. The IFCs 48 conditions the air flow at each individual fuel nozzle 12, thereby improving the uniformity of air flow through each fuel nozzle 12. The compressed air 38 that enters the fuel nozzles 12 via the IFCs 48 (e.g., through inlet perforations 50) mixes with fuel and flows through an interior volume 52 of the combustor liner 44, as illustrated by arrow 54. The air and fuel mixture flows into a combustion cavity 56, which may function as a combustion burning zone. The heated combustion gases from the combustion cavity 56 flow into a turbine nozzle 58, as illustrated by arrow 60, and further downstream to the turbine 18.

Figure 4:
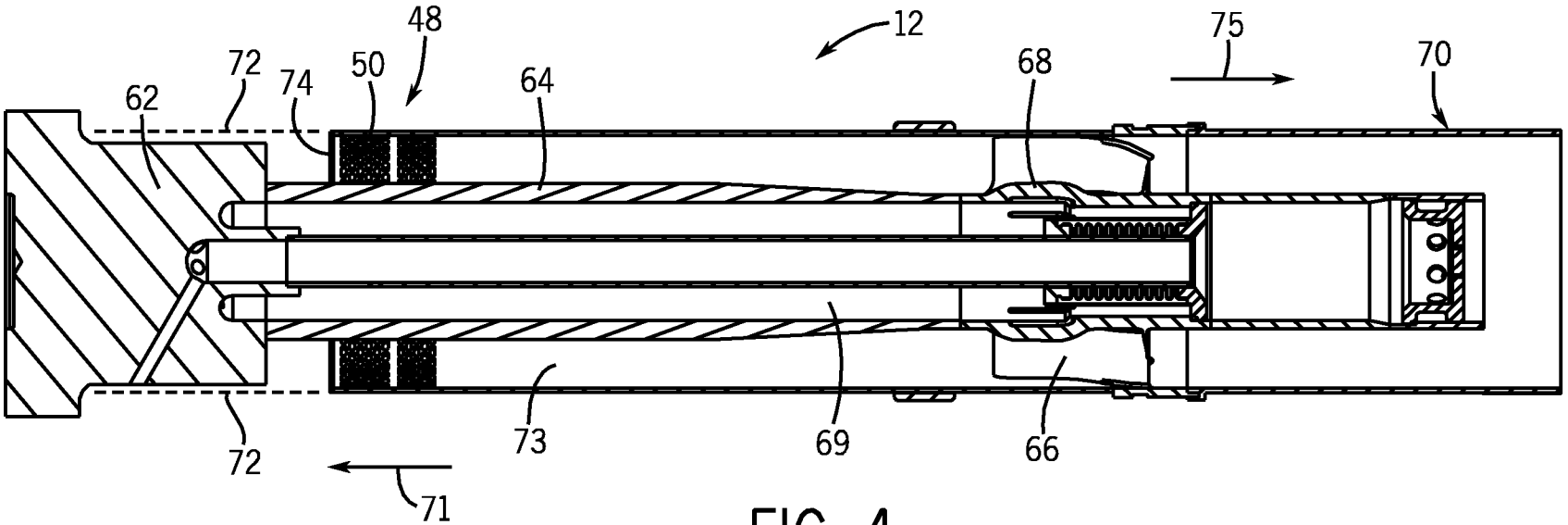
FIG. 4 is a cross sectional side view of a single fuel nozzle, as illustrated in FIG. 2, in accordance with an embodiment of the present technique.

FIG. 4 is a cross-sectional schematic illustration of a fuel nozzle 12. The fuel nozzle 12 may include a mounting base or flange 62, a center body assembly 64, one or more swirl vanes 66, a fuel supply assembly 68, an external wall 70 (e.g., annular outer wall). As illustrated, the external wall 70 is axially offset from the flange 62. In certain embodiments, the flange 62 may directly couple to the external wall 70, as illustrated by dashed lines 72. In other words, one exemplary embodiment of the illustrated fuel nozzle 12 may integrate the external wall 70 with the flange 62, thereby creating external structural support (e.g., load bearing support) along the axial length of the fuel nozzle 12. For example, the external wall 70 may extend directly from the flange 62 along the dashed lines 72, thereby substantially increasing the stiffness and load bearing capacity of the fuel nozzle 12. Furthermore, by integrating the external wall 70 with the flange 62, the external structural support also includes the inlet flow conditioner (IFC) 48 with perforations 50.

In certain embodiments, the center body assembly 64 may include or exclude structural support for the fuel nozzle 12. In other words, the center body assembly 64 may be designed with more material to bear a load, or alternatively less material to not bear a load. In either configuration, the extension 72 of the external wall 70 may substantially bear any loads on the fuel nozzle 12, thereby reducing any need for internal structural support inside the fuel nozzle 12 via the center body assembly 64. Thus, the disclosed embodiments may substantially reduce the complexity and structural rigidity of the center body assembly 64 to reduce costs, thereby rending the center body assembly 64 a non-load bearing structure. Instead, the center body assembly 64 may be designed solely for the design considerations of passing a particular fluid, e.g., fuel, air, water, diluent, etc.

As illustrated in FIG. 4, the flange 62 is configured to mount to the end cover 36 via bolts or other fasteners. The IFC 48 includes the perforations 50 to condition the air flow into an annular passage 73 between the external wall 70 and the center body assembly 64. The IFC 48 is configured to provide a more uniform distribution of the air flow about the circumference of the external wall 70 into the annular passage 73, while also breaking up any large scale structures (e.g., vortices) in the air flow. In the illustrated embodiment, the fuel nozzle 12 may include a disc-shaped air flow conditioner 74 adjacent the perforations 48. Furthermore, the perforations 48 may extend along the extension 72, such that the perforations 48 may be in an upstream direction 71 and downstream direction 75 from the air flow conditioner 74. Downstream 75 from the IFC 48, the swirl vanes 66 are configured to induce swirling motion of the air flow. In addition, the fuel supply assembly 68 is configured to pass a fuel (e.g., liquid or gas fuel) through the center body assembly 64 in the downstream direction 75 toward a fuel injection region, e.g., at swirl vanes 66, for fuel-air mixing. It should also be noted that the fuel supply assembly 68 may also be surrounded by an air passage 69 inside of the center body assembly 64.

In one embodiment, the extension 72 may expand in an upstream 71 or a downstream direction 75 in response to, for example, thermal inputs. Accordingly, the extension 72 may, for example, slide along the flange 62 and move in an upstream 71 and downstream direction 75 with respect to the center body assembly 64. The extension 72 may, for example, be made from an expandable and compressible material that allows for the above mentioned upstream 71 and downstream directional 75 movement. Alternatively, the extension may be affixed to the flange 62 via a pin that allows for upstream 71 and downstream directional 75 movements. Furthermore, it is envisioned that the extension 72 may remain stationary while, for example, the center body assembly 64 moves in an upstream 71 and downstream direction 75.

Figure 5:
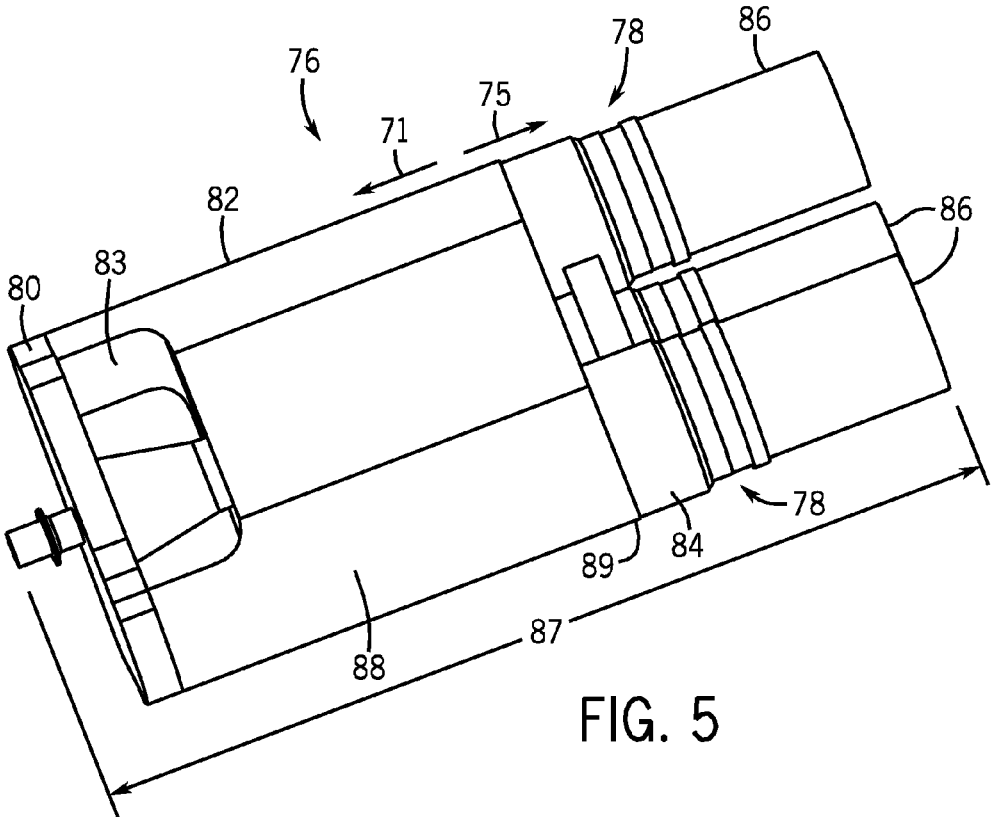
FIG. 5 is a perspective view of a tri-nozzle that may be utilized in conjunction with the combustor illustrated in FIG. 3, in accordance with an embodiment of the present technique.

FIG. 5 illustrates a perspective view of a multi-nozzle assembly, e.g., a tri-nozzle 76, having integrated load bearing and air flow conditioning features. The tri-nozzle 76 may include three individual fuel nozzles 78 integrally mounted on a single mounting base 80 via an IFC 82. The fuel nozzles 78 may be operationally similar to the fuel nozzles 12 described above, however, the fuel nozzles 78 may exclude the center body assembly 64 as a source of internal structural support for the nozzles 78. Instead, the nozzles 78 may be externally structurally supported by the IFC 82. As appreciated, the IFC 82 may operate to condition the air flow by breaking up large scale structures (e.g., vortices), more uniformly distributing the air flow, and so forth. In turn, the IFC 82 routes the air flow to a swirl vane assembly 84, which may include one or more fuel vanes associated with each fuel nozzle 78 in the tri-nozzle 76.

As illustrated, the IFC 82 may be directly affixed to the mounting base 80, for example, via a weld, a diffusion bond, bolts, screws, or the like. In certain embodiments, the mounting base 80 and the IFC 82 may be integrally formed as a single structure via casting, machining, and so forth. The mounting base 80 is configured to mount the tri-nozzle 76 to the head end 34 of the combustor 16. Furthermore, the IFC 82 may be a single column that traverses the outer perimeter of all three nozzles 78. For example, the IFC 82 may include an external structure or outer wall 88 that surrounds all three nozzles 78, and extends axially along all three nozzles 78 from the mounting base 80 to burner tubes 86 for the three nozzles 78. In certain embodiments, the IFC 82 may include a single structure or multiple segments defining the outer wall 88. For example, the tri-nozzle 76 may include one IFC 82 per nozzle 78, while still providing external structural support for each fuel nozzle 78, the IFC 82 may further include air inlets 83 that may be used as an air supply for reception of air that may flow in a downstream direction through the IFC 82, in a manner similar to that described above with respect to FIG. 4. The air inlets 83 may be utilized in conjunction with or instead of inlet perforations 50, previously discussed.

The dimensions (e.g., thickness) of the outer wall 88 may modified (i.e., increased or decreased) to vary the structural load bearing capability of the tri-nozzle 76. Likewise, the dimensions (e.g., length, width, thickness) of the outer wall 88 may be modified to tune the tri-nozzle 76 to a particular natural frequency. For example, the thickness of the outer wall 88 may be approximately 0.02 to 1.5 inches. In another embodiment, the thickness of the outer wall 88 may be approximately 0.04, 0.065, 0.09, 0.125, or 0.25 inches. Thus, the natural frequency of the tri-nozzle 76 may be adjusted, for example, to frequencies above the rotor frequency of the combustor 16, to reduce harmonic failures in the combustor 16. In this manner, the IFC 82 may be modified depending on the turbine engine, the fuel (e.g., liquid or gas fuel), and other design considerations. Other modifications may include adjusting the overall length 87 of the tri-nozzle 76. For example, the length 87 of the tri-nozzle 76 may be between approximately 20 and 25 inches. In another embodiment, the length 87 of the tri-nozzle 76 may be between approximately 15 and 30 inches. In addition, the material utilized to manufacture the tri-nozzle 76 may be, for example, steel, or an alloy containing, for example, cobalt and/or chromium. It should be noted that the air as it passes through the IFC 82 may be, for example, 50 to 1300 degrees Fahrenheit, while the burner 86 tubes may be exposed to temperatures of approximately 3000 or more degrees Fahrenheit.

Furthermore, the tri-nozzle 76 may include a slidable joint 89 that allows for expansion in an upstream 71 and downstream direction 75 of the outer wall 88 from the swirl vane assembly 84. This expansion may be caused by, for example, thermal stresses. The expansion may cause either the outer wall of the nozzle 76 to move in an upstream 71 and downstream direction 75 relative to the swirl vane assembly 84 and the fuel nozzles or the swirl vane assembly 84 to move in an upstream 71 and downstream direction 75 relative to the outer wall 88.

Figure 6:
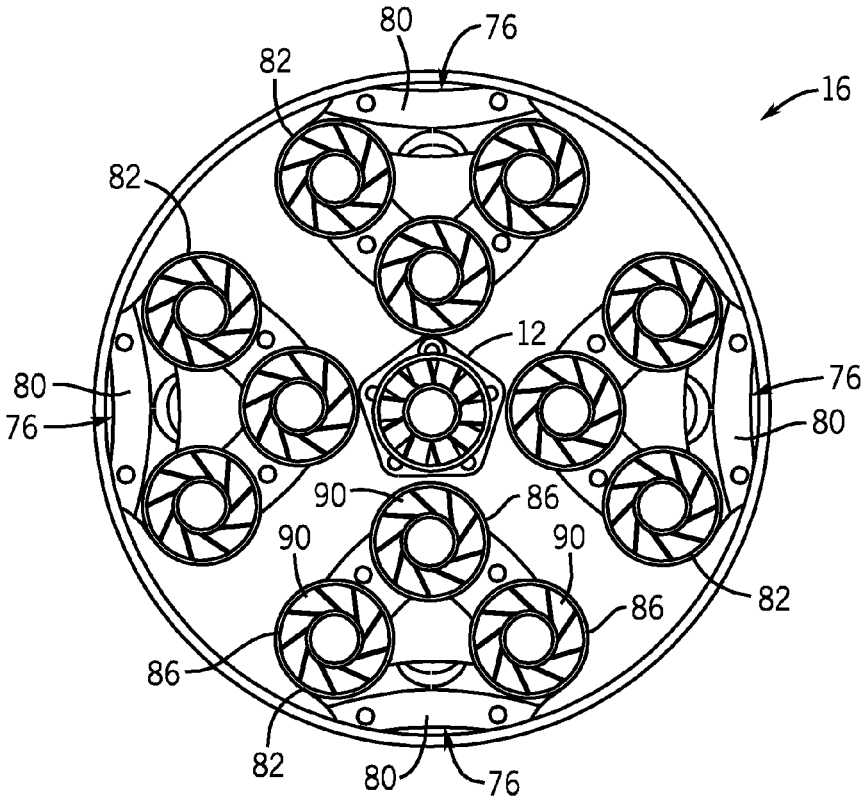
FIG. 6 is a front view of a combustor utilizing tri-nozzles, as illustrated in FIG. 5, in accordance with an embodiment of the present technique.

FIG. 6 illustrates a front view of an embodiment of the combustor 16 having the tri-nozzles 76 of FIG. 5. As discussed above, each tri-nozzle 76 includes the mounting base 80 directly coupled to the IFC 82, thereby providing external structural support and air flow conditioning for all three fuel nozzles 78 in each tri-nozzle 76. In each tri-nozzle 76, each fuel nozzle 78 includes a swirl vane region 90 within the respective burner tube 86. As illustrated, the tri-nozzles 76 may be in an annular configuration circumferentially around a central fuel nozzle 12 of the combustor 16. Furthermore, each of the fuel nozzles 78 of the tri-nozzle 76 may be laterally offset from one another in a triangular pattern. For example, the nozzles 78 may form an isosceles right triangle configuration. Alternatively, the nozzles 78 may form an equilateral triangle configuration, an isosceles triangle configuration, or any other triangle configuration. Indeed, the exact configuration of the nozzles 78 in the tri-nozzle 76 may be determined, for example, based on the thermal stresses and strains that may be encountered during use in the combustor 16.

Figure 7:
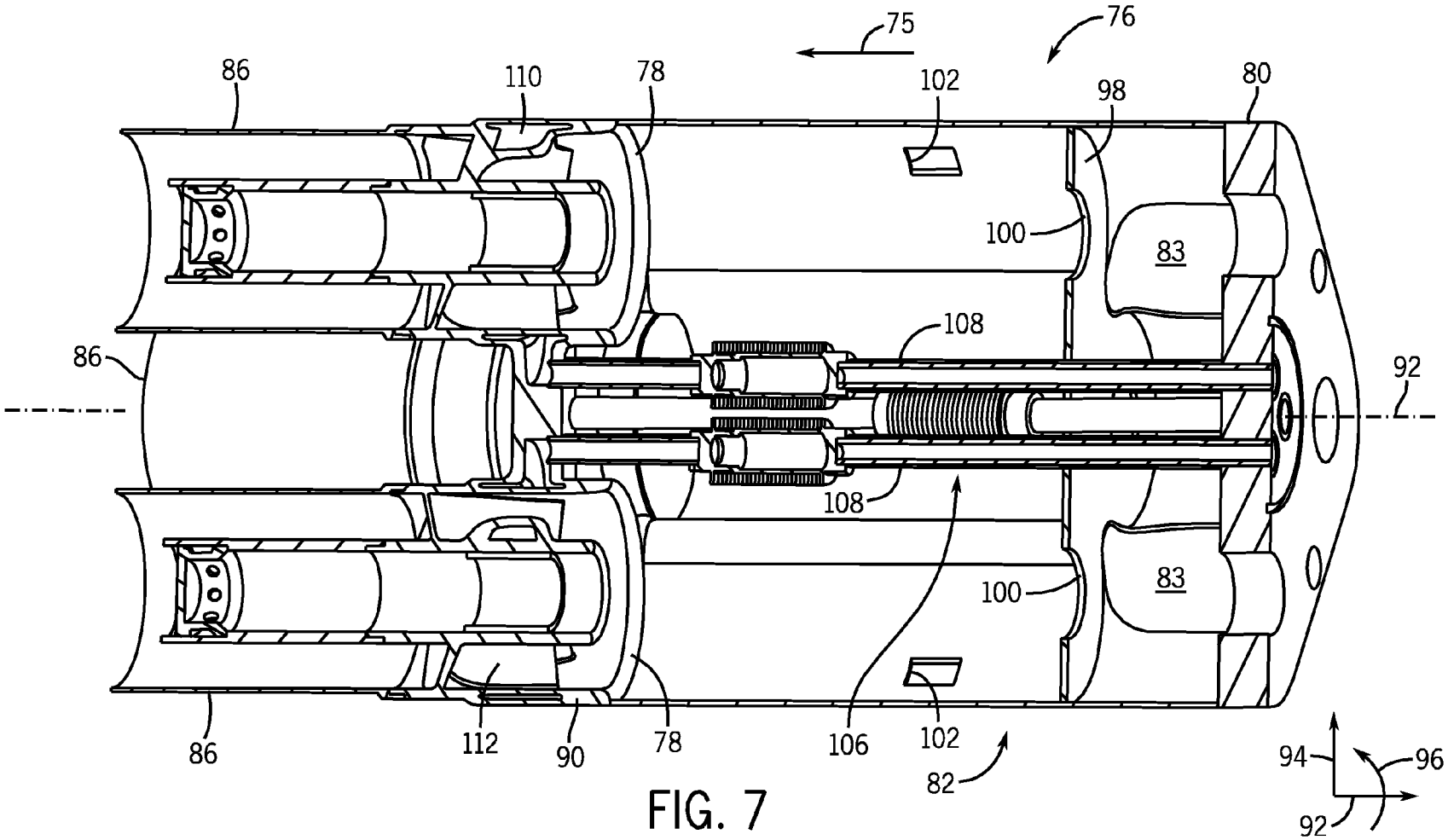
FIG. 7 is a cross sectional side view of a tri-nozzle, as illustrated in FIG. 5, in accordance with an embodiment of the present technique.

FIG. 7 is a cross sectional side view of a tri-nozzle 76, as illustrated in FIG. 5, in accordance with an embodiment of the present technique. It should be noted that various aspects of the tri-nozzle 76 may be described with reference to an axial direction or axis 92, a radial direction or axis 94, and a circumferential direction or axis 96. For example, the axis 92 corresponds to a longitudinal centerline or lengthwise direction, the axis 94 corresponds to a crosswise or radial direction relative to the longitudinal centerline, and the axis 96 corresponds to the circumferential direction about the longitudinal centerline.

The tri-nozzle 76 may include three fuel nozzles 78, the mounting base 80, the IFC 82, the three burner tubes 86, the outer wall 88 of the IFC 82, and the three swirl vane regions 90, which may operate as described above with respect to FIG. 5. Moreover, while a tri-nozzle 76 is illustrated in FIG. 7 and explained herein, it should be appreciated that the following discussion may apply to a bi-nozzle (with two pre-mixers), a quad-nozzle (with four pre-mixers), etc. That is, any number of nozzles greater than one may be encompassed with respect to the description below.

The tri-nozzle 76 may include one or more air inlets 83 that may be utilized to supply air to the IFC 82. As previously noted, the air inlets 83 may be utilized in conjunction with or instead of the inlet perforations 50 previously discussed. The air inlets 83 may be disposed circumferentially 96 about the longitudinal axis 92 within the outer wall 88 of the IFC 82. The air inlets 83 may be approximately 20 to 80 percent, 30 to 70 percent, or 40 to 60 percent of the inner diameter of the outer wall 88. The air inlets may be approximately 35 percent, 40 percent, 45 percent, 50 percent, 55 percent, or 60 percent of the inner diameter of the outer wall 88. Thus, the tri-nozzle 76 may receive air in radial direction 94 through the outer wall 88 via the air inlets rather than, for example, from the axial direction 92 through the mounting base 80. In another embodiment, air may also be received in the axial direction 92 through the mounting base 80. In certain embodiments, the tri-nozzle 76 may include perforations (e.g., a plurality of small openings) in the outer wall 88 of the IFC 82, thereby enabling air flow through the outer wall 88 into the interior of the tri-nozzle 76. The perforations (if included) may be at least less than approximately 1, 2, 3, 4, 5, 6, 7, 8, 9, 10, or 15 percent of the inner diameter of each burner tube 86.

The air may flow into the IFC 82 via the air inlets 83 and may encounter a lateral support 98 that may extend crosswise (i.e., in the radial direction 94) relative to the longitudinal axis 92 of the tri-nozzle 76 in the inlet flow conditioner 82. In one embodiment, the lateral support 98 may be a clover-leaf shaped plate. The shape and the positioning of the lateral support 98 may serve at least two purposes. First, the lateral support 98 may operate as an additional internal support member in conjunction with the IFC 82 for the tri-nozzle 76. Additionally, the lateral support 98 may aid in the channeling of the air flow in a manner to provide more uniform air flow distribution among the fuel nozzles 78, which also improves the uniformity of air flow into each individual fuel nozzle 78. As illustrated, the lateral support 98 includes three central openings 100, one for each air inlet 83. For example, the central openings 100 may be approximately 10 to 70 percent, 20 to 60, or 30 to 50 percent of the inner diameter of each burner tube 86. Alternatively, central openings 100 may not be placed in the lateral support 98, rather, the lateral support 98 may be perforated with a plurality of small openings, e.g., 10, 20, 30, 40, 50, 100, 200, or more openings per fuel nozzle 78. By further example, the perforations (if included) may be at least approximately 0.05 to 50 percent of the inner diameter of each burner tube 86. It should be noted that the perforated lateral support 98 may also be used in conjunction with the central openings 100.

In certain embodiments, the tri-nozzle 76 may include a plurality of lateral supports 98 at different axial positions along the longitudinal axis 92. For example, the tri-nozzle 76 may include 1, 2, 3, or more lateral supports 98 equally or unequally spaced along the longitudinal axis 92, wherein each lateral support 98 may include identical or different configurations of openings and/or perforations.

As illustrated, the air inlets 83 are disposed axially upstream of the lateral support 98. Additionally, the tri-nozzle 76 may include one or more air inlets 102 in the outer wall 88 axially upstream and/or downstream relative to the lateral support 98. For example, the outer wall 88 may include a circular array of air inlets 102 about in the circumferential direction 96 about the longitudinal axis 92. In certain embodiments, these air inlets 102 may include relatively large openings, e.g., at least greater than 15, 20, or 25 percent of the inner diameter of each burner tube 86. Alternatively or in addition to these relatively large openings, these air inlets 102 may include relatively small openings, e.g., at least less than 1 to 20 percent of the inner diameter of each burner tube 86. For example, these air inlets 102 may include a pattern of openings or perforations axially along and circumferentially about the outer wall 88.

The tri-nozzle 76 may additionally include a fuel passage assembly 106 that may include individual fuel passages 108 that may each correspond to one of the fuel nozzles 78. The fuel passages 108 may each include flexible passages, (e.g., fuel bellows that may aid in the regulation of downstream 75 fuel flow), to accommodate thermal growth. Thus, the fuel passages 108 individually, and collectively as the fuel passage assembly 106, contribute little or no structural support to the tri-nozzle 76, (e.g., the fuel passages 108 are non-load bearing fuel passages 108 extending in the downstream direction 75 from the mounting base 80). That is, the IFC 82 comprises an outer wall 88 extending directly from the mounting base 80 in the downstream direction 75, where the outer wall 88 is load bearing, and the tri-nozzle 76 excludes a load bearing fuel line 68. Instead, the fuel passages 108 merely function as a supply device to provide fuel to a fuel plenum 110, which may circumferentially 96 surround each of the swirl vane regions 90. The fuel plenum 110 may, in one embodiment, provide fuel directly into swirl vanes 112 of the swirl vane region 90 for injection into the burner tube 86.

Accordingly, the tri-nozzle 76 receives structural support from the IFC 82, the mounting base 80, and the lateral support 98, without receiving any structural support from a center body assembly. That is, the IFC 82 may structurally support the tri-nozzle 76 without a central support member 64 extending directly from the mounting base 80 inside the IFC 82. Furthermore, in addition to providing structural support for the tri-nozzle, the IFC 82 is designed to condition air for more uniform and even distribution to each of the fuel nozzles 78, leading to more efficient fuel and air mixing. This may lead to a cleaner burning fuel/air mixture and, subsequently, less exhaust pollutants.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a turbine engine, comprising:

a combustor having a head end region; and a plurality of multi-nozzle assemblies, wherein each of the plurality of multi-nozzle assemblies comprises a plurality of swirl vane assemblies, each multi-nozzle assembly having a mounting base coupled to the head end region, wherein each multi-nozzle assembly comprises an inlet flow conditioner extending to the mounting base, the inlet flow conditioner comprises a load-bearing annular wall defining therethrough a plurality of air inlets, and the inlet flow conditioner structurally supports each multi-nozzle assembly at the mounting base, wherein each multi-nozzle assembly consists of a tri-nozzle that includes three fuel nozzles arranged in a generally triangular pattern.

2. The system of claim 1, wherein the three fuel nozzles share the mounting base and the inlet flow conditioner.

3. The system of claim 1, wherein each swirl vane assembly of each multi-nozzle assembly comprises its own inlet flow conditioner.

4. The system of claim 1, wherein each multi-nozzle assembly comprises a lateral support extending crosswise relative to a longitudinal axis of each multi-nozzle assembly, the lateral support being inside the inlet flow conditioner.

5. The system of claim 4, wherein the lateral support comprises a clover-leaf shaped plate.

6. The system of claim 4, wherein the plurality of air inlets comprise a first air inlet disposed upstream of the lateral support.

7. The system of claim 6, wherein the plurality of air inlets comprise a second air inlet disposed downstream of the lateral support.

8. The system of claim 1, comprising a non-load bearing fuel passage extending in the downstream direction from the mounting base.

9. A system, comprising:

a plurality of multi-nozzle assemblies, wherein each of the plurality of multi-nozzle assemblies comprises:

a plurality of swirl vane assemblies;

a mounting base;

an inlet flow conditioner extending directly from the mounting base in a downstream direction, the inlet flow conditioner comprising a load-bearing annular wall defining therethrough a plurality of air inlets; and a lateral support disposed inside the inlet flow conditioner, wherein the lateral support extends crosswise relative to a longitudinal axis of each multi-nozzle assembly, wherein each multi-nozzle assembly consists of a tri-nozzle that includes three fuel nozzles arranged in a generally triangular pattern.

10. The system of claim 9, wherein the three fuel nozzles share the mounting base and the inlet flow conditioner.

11. The system of claim 9, wherein the mounting base is configured to mount to a head end region of a turbine combustor.

12. The system of claim 9, comprising a non-load bearing fuel passage extending in the downstream direction from the mounting base.

13. The system of claim 9, wherein each multi-nozzle assembly comprises a flexible fuel line extending from the mounting base to a swirl vane downstream from the mounting base, the swirl vane being part of the swirl vane assembly.

14. The system of claim 9, wherein the mounting base comprises an air inlet, and the lateral support comprises an air opening configured to condition an air flow.

15. A system, comprising:

a plurality of multi-nozzle assemblies, wherein each of the plurality of multi-nozzle assemblies comprises:

a plurality of swirl vane assemblies;

a mounting base; and an inlet flow conditioner extending directly from the mounting base in a downstream direction, wherein the inlet flow conditioner comprises a load-beating annular wall defining therethrough a plurality of air inlets, such that the inlet flow conditioner structurally supports each multi-nozzle assembly, wherein each multi-nozzle assembly consists of a tri-nozzle that includes three fuel nozzles arranged in a generally triangular pattern, the three fuel nozzles sharing the mounting base and the inlet flow conditioner.

16. The system of claim 15, comprising a lateral support extending crosswise relative to a longitudinal axis of each multi-nozzle assembly, the lateral support being inside the inlet flow conditioner.

* * * * *